United States Patent [19]

Moody

[11] Patent Number: 4,805,662

[45] Date of Patent: Feb. 21, 1989

[54] HOT WATER HEATER FAILURE PROTECTION DEVICE WITH SOLENOID

[76] Inventor: Ronald W. Moody, 5371 N.W. 32 St., Margate, Fla. 33063

[21] Appl. No.: 146,333

[22] Filed: Jan. 21, 1988

[51] Int. Cl.[4] ..... H16K 33/00; H01H 29/04; H01H 35/18

[52] U.S. Cl. ..... 137/312; 122/504.2.507; 126/388; 137/392; 137/434; 200/61.04; 200/61.05; 200/84 R; 307/118; 340/625; 361/178

[58] Field of Search ..... 137/312, 392, 434; 200/61.04, 61.05, 84 R; 122/504.2, 505, 507; 126/344, 374, 383, 388; 340/604, 605, 620, 623, 624, 625; 73/313; 307/118; 361/178

[56] References Cited

U.S. PATENT DOCUMENTS

| | | | |
|---|---|---|---|
| 2,432,367 | 12/1947 | Andresen | 200/61.04 |
| 2,456,698 | 12/1948 | Hall | 126/344 |
| 3,473,553 | 10/1969 | Collins | 137/312 |
| 3,770,002 | 11/1973 | Brown | 137/312 |
| 3,874,403 | 4/1975 | Fischer | 200/61.04 |
| 3,920,031 | 11/1975 | Maxfield | 137/312 |
| 4,246,575 | 1/1981 | Purtell et al. | 200/61.04 |
| 4,305,420 | 12/1981 | Nussdorf | 200/61.04 |
| 4,380,243 | 4/1983 | Braley | 137/387 |

*Primary Examiner*—George L. Walton
*Attorney, Agent, or Firm*—Malin, Haley & McHale

[57] ABSTRACT

A ground fault interrupter (GFI) circuit is wired to a main circuit breaker panel. A first output of the ground fault interrupter circuit provides electrical current to a solenoid valve that controls the supply of cold water to a conventional hot water heater. The solenoid valve is held in its open position by 110 V. alternating current and is closed by spring biasing means when the current is cut off. The other output of the GFI circuit provides 110 V. alternating current to a leak detector. A leak detecting system directs leakage to a collector wherein the presence of water in the collector completes the circuit between the hot wire and ground of the second outlet. When the circuit is shorted out to ground by the presence of water the GFI circuit is tripped at the main circuit breaker panel and simultaneously cuts off current to the solenoid valve controlling the flow of water to the heater permitting the spring to bias the valve shut and preventing any water damage due to leakage.

2 Claims, 2 Drawing Sheets

HOT WATER HEATER FAILURE PROTECTION DEVICE WITH SOLENOID

BACKGROUND OF THE INVENTION

In earlier years leakage of water from a hot water heater, washing machine or other water supplied appliance was not much of a problem since most water heaters and washing machines were normally located in the basement of the home which usually had a concrete floor with a drain therein. Thus the water would gravitate to the drain and not present any serious problem. Additionally, the housewife or person attending to the washing machine was usually around to take appropriate action, such as shutting off the main water valve.

Today, the modern housewife is, in most instances, a wage earner who spends as much time away from the home as her partner. Additionally, the traditional single family home, in many instances, has been replaced by large buildings housing many individual dwelling units. These large high-rise buildings have become popular in the form of apartments and condo units each provided with their own hot water heater and washing machine units.

It can readily be seen that an unattended water leak on the tenth floor of a multi-story building could cause considerable damage to the unit where the leak occurred as well as untold damage to the units below. It is with this scenario in mind that applicant has sought to provide some measure of protection to the homeowner in the event of a water leak during his absence whether it be for a short or prolonged period of time.

SUMMARY OF THE INVENTION

The instant invention, in its first embodiment, utilizes a ground fault interrupter (GFI) circuit wherein one outlet of the circuit supplies 110 V. alternating current to a solenoid controlled valve which controls the supply of cold water to the hot water heater. A leak detector system is used to direct leakage water to a collector unit. The collector unit is provided with an electrical connection to the other outlet of the GFI circuit. The hot wire of the three wire plug is connected to a metal conductor within the collector at a predetermined insulated distance from the base of the collector. Between the conductor and the base of the collector is positioned the ground of the three wire plug. When leakage water collects in the collector and rises to the level of the metal conductor, the circuit to ground is completed thus tripping the circuit at the main breaker panel and cutting off the supply of current to the solenoid valve permitting a spring to bias the valve into closed position and shutting off the flow of water thereby preventing any water damage.

A second embodiment utilizes a two-position float controlled switch. In the first position, the circuit is completed to the solenoid valve, thus holding the valve open and allowing water to flow into the hot water heater. In the second position, when the float has risen due to the presence of water in the collector, the circuit to the solenoid valve is disrupted allowing the water supply valve to close and after slight further upward movement of the float arm a circuit to an alarm bell is completed whereby the bell will ring continuously to attract attention to the problems at hand.

OBJECTS OF THE INVENTION

An object of the invention is the provision of a safety system which prevents water damage due to leakage.

Another object of the invention is the provision of a system which utilizes a ground fault interrupter circuit to sense leakage of water and simultaneously shut off the supply of water to the unit.

A further object of the invention is to provide an audible alarm in addition to shutting off the water supply.

A still further object of the invention is the provision of a simple yet reliable and economical system for controlling water damage due to leakage.

Another object of the invention is the provision of a collector pan with a float controlled two-position switch for shutting off the water supply and subsequently energizing an alarm.

A further object of the invention is the provision of a stationary sensing means to shut off the water supply.

These and other objects of the invention will become more apparent hereinafter, the instant invention will now be described with particular references to the accompanying drawings which form a part of this specification wherein like reference characters designate the corresponding parts in the several views.

DETAILED DESCRIPTION OF TH DRAWINGS

Figure 1:
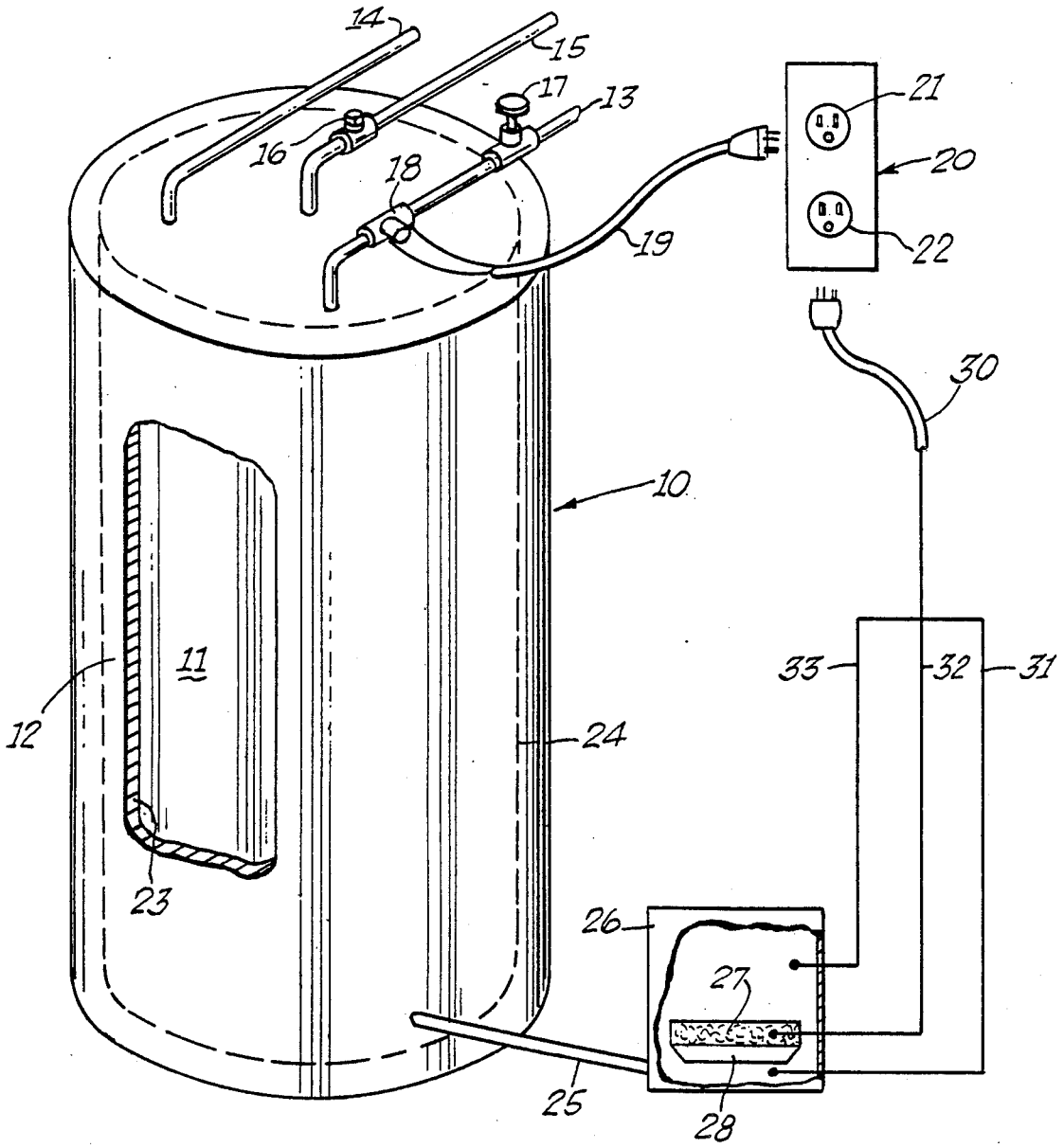
FIG. 1 is a diagrammatic illustration of the leakage detector system utilizing a ground fault interrupter (GFI) circuit.

Referring now to FIG. 1, there is shown a first embodiment of the instant invention. Hot water heater generally indicated by reference numeral 10 consists of water tank 11 which is enveloped by outer housing 12. Between water tank 11 and outer housing 12 is the normal layer of fiberglass insulation, not shown. Hot water heater 10 is provided with a cold water inlet 13 and a hot water outlet 14. Positioned between cold water inlet 13 and hot water outlet 14 is the usual pressure relief line 15 which is provided with a pre-set pressure relief valve 16. The purpose of pressure relief valve 16 is to relieve excess pressure in water tank 11. Cold water inlet line 13 is provided with a manual cut-off valve 17 which controls the flow of cold water in line 13 and is normally in the "open" position once the unit has been installed. The purpose of cut-off valve 17 is to permit working on hot water heater 10 should it become necessary to replace the unit. Downstream of manual cut-off valve 17 is an electrical solenoid operated valve 18 which is supplied with current by a first electrical line 19 which is provided with a three-pronged plug that is received in upper outlet 21 of ground fault interrupter circuit 20.

As illustrated, outer housing 12 is broken away at 23 to show water tank 11 therein. The general outline of water tank 11 is shown by broken lines 24. Spaced a short distance from the bottom of outer housing 12 is drain line 25 which projects through outer housing 12. Line 25 is open to the space between outer housing 12 and water tank 11 and extends through the wall of leakage collector 26. Leakage collector 26 has been broken away to illustrate the inner components. Fixedly mounted within leakage collector 26 is a stationary metal conductor 27 which is provided with an insulating material 28 such as styrofoam attached to the bottom of metal conductor 27. A second electrical line 30 with a three-pronged plug is received in lower outlet 22 of ground fault interrupter circuit 20. Second electrical line 30 is also a three-wire line the same as first electrical line 19. However, its hook-up is different from that of first electrical line 19. First electrical line 19 has the hot wire and neutral wire connected to terminals on opposite sides of the solenoid 18, with its ground wire connected to ground in the usual manner. Second electrical line 30 has its ground wire 31 enter into leakage collector 26 at a point below metal conductor 27. Hot wire 32 of second electrical line 30 is connected to metal conductor 27 and neutral wire 33 enters into leakage collector 26 and is fixed at a predetermined distance above metal conductor 27 with nothing connected to it. All three lines 31, 32 and 33 are properly separated and insulated as they enter leakage collector 26.

The operation of the embodiment shown in FIG. 1 is as follows: Three-way plugs of first and second electrical lines 19 and 30 are plugged into upper and lower outlets 21 and 22, respectively. As long as there is no water leaking from water tank 11 the system will operate in the usual manner of a conventional hot water heater. However, in the event of a leak in water tank 11, water will accumulate at the base of hot water heater 10 and after raising a short distance the water which is confined in the space between water tank 11 and outer housing 12 will flow through drain line 25 and collect in the bottom of leakage collector 26 until the water level in leakage collector 26 reaches metal conductor 27. Since water is an excellent electrical conductor hot wire 32 will be grounded to ground wire 31 via the water. As a result of this grounding, the ground fault interrupter circuit 20 is tripped at the main circuit breaker panel, thus tripping the supply of current to electrical solenoid valve 18. Since electrical solenoid valve 18 was held in its "open" position by electrical current, interruption of electrical current releases the valve which is then biassed into "closed" position by a spring in the valve mechanism. Once the supply of water to hot water heater 10 is terminated there is no longer any danger of water damage due to a leak in water tank 11 regardless of the length of time it takes before the problem is recognized. Thus it can be seen that applicant has eliminated what could have been a very serious problem, especially so, if the leak occurred while the occupants were away on an extended vacation.

Figure 2:
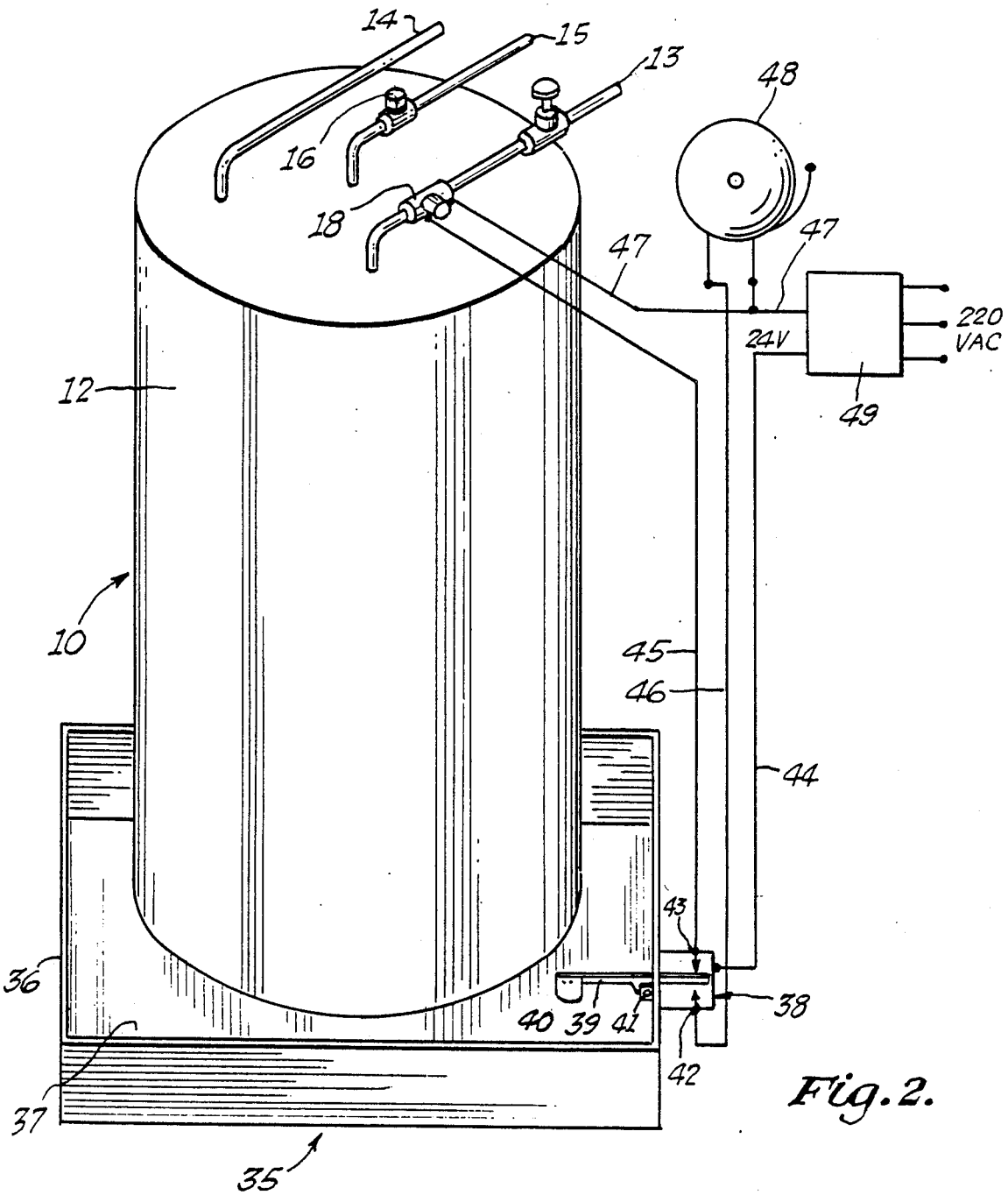
FIG. 2 is a diagrammatic illustration of another embodiment using the 220 V. supply to the hot water heater reduced to 24 V. to control the water supply and actuate the alarm.

Referring now to FIG. 2, there is shown a diagrammatic illustration of a second embodiment of a leakage detector. Again, hot water heater is generally indicated by reference numeral 10 with an outer housing 12 enclosing the water tank (not shown). Cold water inlet line 13 supplies cold water to the water tank and is provided with a manual shut-off valve 17. Hot water line 14 is connected to the top of the water tank and relief line 15 is provided with a pressure relief valve 16 in the same manner as the FIG. 1 embodiment. Hot water heater 10 is placed inside of leakage collector tray 35 which is provided with peripheral wall 36 which extends upwardly several inches from base 37. Mounted on peripheral wall 36 is float operated switch 38 which consists of a pivotally mounted arm 39 and float 40 at its free end. It should be noted that other types of sensors may be used in place of float 40. The outer end of arm 39 is in contact with electrical line 44. When the float 40 is in its horizontal position, a contact point on arm 39 is in electrical contact with upper terminal 43 and thus current is supplied to electrical solenoid valve 18 by way of electrical line 45. When current is applied to solenoid valve 18 the valve is opened and cold water is allowed to flow into the hot water heater 10. As indicated before, this is the "normal" position of arm 39 and float 40. However, once the water tank develops a leak, water will leak out of outer housing 12 and collect in leakage collector tray 35. Once the water level in collector try 35 reaches float 40 it will raise arm 39 since it is mounted on pivot point 41. As arm 39 moves up it breaks the electrical contact with upper terminal 43 and further upward movement of arm 39 brings it into contact with lower terminal 42 thus completing the electrical circuit via line 46 to alarm bell 48. When current to solenoid valve 18 is interrupted, valve 18 automatically closes due to the bias of a spring contained therein. Shortly after the closing of valve 18 the alarm is energized to alert someone that there is a leak in hot water heater 10 and appropriate action can be taken.

Figure 3:
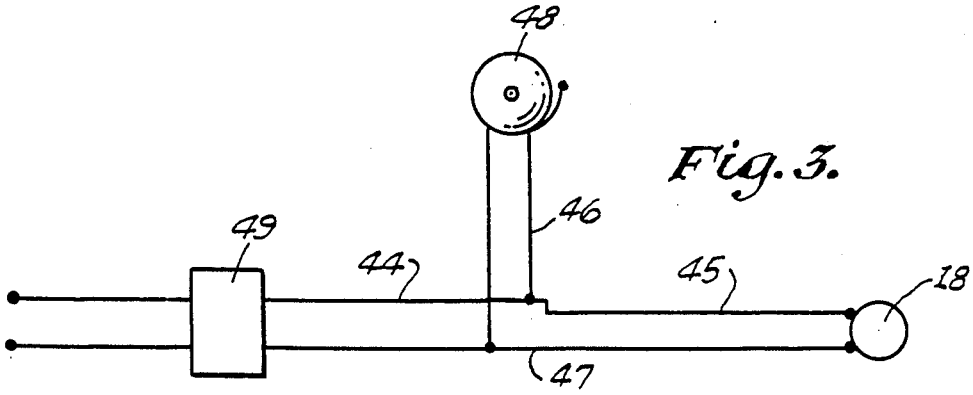
FIG. 3 is a diagrammatic illustration of the electrical circuit utilized in the FIG. 2 embodiment.

Referring now to FIG. 3, there is shown a schematic electrical diagram of the circuit used in the FIG. 2 embodiment. As shown, line voltage at 220 volts is fed into step-down transformer 49 which reduces the line voltage to 24 volts. On the output side of transformer 49 line 47 which is the neutral wire for the solenoid 18 and the alarm 48. Line 44, the hot wire, is connected to either line 45 or line 46 depending on the position of float 40 and arm 39.

As can readily be seen the instant invention has uses in environments other than those specifically set forth. It can find use with any type of appliance or water risers or mains which requires the use of water and is susceptible to leakage. The instant invention provides an inexpensive means of controlling unnoticed leakage whether the homeowner is present or not.

While the invention has been described in its preferred embodiments, it is to be understood that words which have been used are words of description rather than limitation and that changes may be made within the purview of the appended claims without departing from the full scope or spirit of the invention.

Having thus described my invention, I claim:

1. A non-complex water leakage detector and automatic cut-off system for installation with special wiring in combination with a hot water heater comprising:

water supply means operably connected to said hot water heater, control means controlling the supply of water to said hot water heater, a leakage collector means operatively connected to said hot water heater and said control means, said leakage collector means for automatically actuating said control means and terminates the flow of supply water to said hot water heater when the presence of leakage water is in said leakage collector means, said control means includes a ground fault interrupter circuit having a first and second electrical outlet plug, an electrical solenoid valve having spring biasing means controlling the flow of water in said water supply means, first electrical connection means connecting said electrical solenoid valve to said first electrical outlet plug; second electrical connection means connecting said leakage collector means to said second electrical outlet plug, said second electrical connection means including a neutral wire, hot wire and ground wire, said hot wire being connected to a metal conductor fixedly mounted in said leakage collector means, said neutral wire mounted in spaced relation above said metal conductor, said ground wire located a predetermined distance below said metal conductor and above the base of said leakage collector means, said leakage collector means completes the electrical connection between said hot wire and said ground wire thus shorting out said ground fault interrupter circuit and terminating supply of electrical current to said electrical solenoid valve permitting a spring biasing means to close said solenoid valve and terminating the supply of water to said hot water heater when water is present in said leakage collector means, said hot water heater includes a water tank and an outer housing enveloping said water tank with a space therebetween and said leak collector means comprises a leakage collector vessel and a conduit interconnecting said space between said water tank and said outer housing with said leakage vessel whereby leakage accumulated in said space at a level of said conduit wherein the water leakage is transferred to said collector vessel to prevent said supply water inflow upon activation of said solenoid valve.

2. A non-complex water leakage detector and automatic cut-off system for installation with special wiring in combination with a hot water heater comprising:

water supply means operably connected to said hot water heater, control means controlling the supply of water to said hot water heater, a leakage collector means operatively connected to said hot water heater and said control means, said leakage collector means for automatically actuating said control means and terminates the flow of supply water to said hot water heater when the presence of leakage water is in said leakage collector means, said control means includes a ground fault interrupter circuit having a first and second electrical outlet plug, an electrical solenoid valve having spring biasing means controlling the flow of water in said water supply means, first electrical connection means connecting said electrical solenoid valve to said first electrical outlet plug; second electrical connection means connecting said leakage collector means to said second electrical outlet plug, said second electrical connection means including a neutral wire, hot wire and ground wire, said hot wire being connected to a metal conductor fixedly mounted in said leakage collector means, said neutral wire mounted in spaced relation above said metal conductor, said ground wire located a predetermined distance below said metal conductor and above the base of said leakage collector means, said leakage collector means completes the electrical connection between said hot wire and said ground wire thus shorting out said ground fault interrupter circuit and terminating supply of electrical current to said electrical solenoid valve permitting a spring biasing means to close said solenoid valve and terminating the supply of water to said hot water heater when water is present in said leakage collector means, said control means comprises an electrical circuit utilizing reduced line voltage, said electrical solenoid valve permitting the flow of supply water in its normally open position, switch means mounted on said collector means whereby the presence of leakage water in said leakage collector means deactivates said electrical solenoid valve thus permitting said electrical solenoid valve to close and cut-off said water supply, said switch means comprises a float operated arm and a pair of electrical terminals connected to said reduced voltage circuit, one of said pair of terminals serving to complete the electrical circuit to said solenoid valve when said float arm is in a first position and the other of said pair of terminals serving to complete the electrical circuit to an alarm bell when said float moves said arm from said first position to a second position due to the presence of leakage water in said collector means, said termination of electrical current to said solenoid valve permits said solenoid valve to close due to spring bias contained therein, said leakage collector means comprises an open collector tray having a base and a raised peripheral wall, said switch means including a pivotally mounted arm on said peripheral wall and said hot water heater is mounted in said leakage collector tray to collect leakage collected from said hot water heater, wherein said control means includes a 240 volt circuit reduced to 24 volts by a step down transformer, a hot wire from the output of said stepdown transformer electrically connected in series with one side of an alarm bell and one side of said electrical solenoid valve controlling the supply of water to said hot water heater and a neutral wire from the output of said stepdown transformer connected to said switch means.

* * * * *